US009993134B2

(12) United States Patent
Dreossi et al.

(10) Patent No.: US 9,993,134 B2
(45) Date of Patent: Jun. 12, 2018

(54) ARRANGEMENT IN A DISHWASHER FOR CREATING A WASH ZONE WITH INTENSIFIED WASHING

(71) Applicant: ELECTROLUX APPLIANCES AKTIEBOLAG, Stockholm (SE)

(72) Inventors: Giuseppe Dreossi, Stockholm (SE); Magnus Wahlberg, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days. days.

(21) Appl. No.: 15/037,529

(22) PCT Filed: Dec. 20, 2013

(86) PCT No.: PCT/EP2013/077768
§ 371 (c)(1),
(2) Date: May 18, 2016

(87) PCT Pub. No.: WO2015/090460
PCT Pub. Date: Jun. 25, 2015

(65) Prior Publication Data
US 2016/0287050 A1 Oct. 6, 2016

(51) Int. Cl.
*A47L 15/23* (2006.01)
*A47L 15/42* (2006.01)

(52) U.S. Cl.
CPC ..... *A47L 15/4282* (2013.01); *A47L 15/23* (2013.01); *A47L 15/4214* (2013.01);
(Continued)

(58) Field of Classification Search
CPC .. A47L 15/23; A47L 15/4214; A47L 15/4282; A47L 15/4289; A47L 2401/06;
(Continued)

(56) References Cited

U.S. PATENT DOCUMENTS 4,174,723 A 11/1979 Long
6,239,416 B1 5/2001 Nomura et al.
(Continued)

FOREIGN PATENT DOCUMENTS

DE 12 91 869 B 4/1969
DE 10 2012 217 568 A1 3/2013
(Continued)

OTHER PUBLICATIONS

International Search Report for International Application No. PCT/EP2013/077768 dated Oct. 30, 2014.
(Continued)

*Primary Examiner* — Levon J Shahinian
(74) *Attorney, Agent, or Firm* — Alston & Bird LLP

(57) ABSTRACT

Provided herein is an arrangement in a dishwasher for creating a wash zone with intensified washing in a washing chamber. The arrangement may include a spray arm rotatably arranged around an axis A; a water pump arranged to feed water to the spray arm; and a control unit arranged to control operation of the water pump. At least one additional nozzle may be is arranged on the spray arm. The additional nozzle may be arranged to be opened when the pressure in the water fed from the water pump to the spray arm exceeds a predetermined level. A dishwasher including the described arrangement is also provided.

19 Claims, 3 Drawing Sheets

(52) U.S. Cl.
CPC ..... *A47L 15/4289* (2013.01); *A47L 2401/06* (2013.01); *A47L 2401/14* (2013.01); *A47L 2501/04* (2013.01); *A47L 2501/05* (2013.01)

(58) Field of Classification Search
CPC ..... A47L 2401/14; A47L 2501/04; A47L 2501/05; A47L 15/22; A47L 15/4208; A47L 15/4278; A47L 2501/20
USPC ..... 134/56 D, 57 D, 58 D, 144, 172, 176, 134/179, 198
See application file for complete search history.

(56) References Cited

U.S. PATENT DOCUMENTS

| | | | | |
|---|---|---|---|---|
| 6,263,888 | B1 * | 7/2001 | Nomura | A47L 15/23 134/179 |
| 2003/0168087 | A1 * | 9/2003 | Inui | A47L 15/4223 134/57 D |
| 2004/0103929 | A1 * | 6/2004 | Ha | A47L 15/4221 134/58 D |
| 2009/0178698 | A1 | 7/2009 | Delgado | |
| 2012/0097199 | A1 | 4/2012 | Tuller | |
| 2012/0097200 | A1 | 4/2012 | Fountain | |
| 2012/0138110 | A1 | 6/2012 | Chen et al. | |
| 2013/0284216 | A1 | 10/2013 | Förster et al. | |

FOREIGN PATENT DOCUMENTS

| | | | | |
|---|---|---|---|---|
| EP | 1 040 486 | A1 | 10/2000 | |
| EP | 1040786 | A1 * | 10/2000 | A47L 15/4282 |
| EP | 1 238 622 | A2 | 9/2002 | |
| EP | 2 030 556 | A1 | 3/2009 | |
| GB | 2 253 341 | A | 9/1992 | |
| JP | 2009-273490 | A | 11/2009 | |
| WO | WO 2013/132458 | A1 | 9/2013 | |

OTHER PUBLICATIONS

International Search Report for International Application No. PCT/EP2013/077769 dated Sep. 11, 2014.
International Search Report for International Application No. PCT/EP2013/077770 dated Oct. 28, 2014.
Office Action European Patent Application No. 13819035.0 dated May 22, 2017.
Written Opinion for International Application No. PCT/EP2013/077768 dated Oct. 30, 2014, 5 pages.
Written Opinion for International Application No. PCT/EP2013/077769 dated Sep. 11, 2014, 8 pages.
Written Opinion for International Application No. PCT/EP2013/077770 dated Oct. 28, 2014, 6 pages.
Restriction Requirement from U.S. Appl. No. 15/037,525 dated Jun. 30, 2017, 9 pages.
Restriction Requirement from U.S. Appl. No. 15/037,523 dated Oct. 6, 2017, 9 pages.
Office Action for U.S. Appl. No. 15/037,525 dated Nov. 2, 2017, 16 pages.
English Translation of Russian Office Action No. 2016129427 dated Nov. 23, 2017, 2 pages.
Office Action for U.S. Appl. No. 15/037,523 dated Dec. 29, 2017, 16 pages.

* cited by examiner

ARRANGEMENT IN A DISHWASHER FOR CREATING A WASH ZONE WITH INTENSIFIED WASHING

CROSS-REFERENCE TO RELATED APPLICATIONS

This application is a national stage application filed under 35 U.S.C. § 371 of International Application No. PCT/EP2013/077768 filed Dec. 20, 2013, which application is hereby incorporated by reference in its entirety.

FIELD OF THE INVENTION

The present invention relates to an arrangement in a dishwasher for creating a wash zone with intensified washing, and a dishwasher comprising said arrangement.

BACKGROUND OF THE INVENTION

Dishwashers are used in domestic kitchens as well as professional kitchens and restaurants for dishing goods such as for example plates, pots, pans etc. Dishwashers comprises a washing chamber in which the dishing goods are packed in one or more baskets to remain in the intended position separated from adjacent items to make it possible for water to circulate within the washing chamber and clean the dishing goods.

Water is circulated in the washing chamber by a pump arranged in the lower section of the washing chamber. The water is lead from the pump via pipes to one, or more, rotating spray arms provided with a number nozzles that are spraying water on the dishing goods to clean the dishing goods. The rotating spray arm is also provided with nozzles arranged in the outer ends of the spray arm and directed sideways to generate the force required to rotate the spay arm around it support in the washing chamber.

In order to adapt the dishwasher to new regulations regarding reduced energy consumption as well as reduced water consumption modern dishwashers have been provided with one or more wash zones, i.e. a selected area within the washing chamber where the amount of water sprayed on the dishing goods is intensified compared to the rest of the dishing chamber. Thereby more dirty dishing goods requiring more intense dishing could be arranged in the wash zone where the dishing is more intense. The increased flow of water is either provided by adding additional nozzles on the inside wall of the dishing chamber alternatively adding a spray arm dedicated the wash zone to direct more water towards the wash zone and thereby optimizing the process and reduce the power consumption and/or water consumption. One example of dishwasher with the described arrangement is disclosed in US2012/0138110. The dishwasher comprises at least one auxiliary spray nozzle arranged on the side wall of a treating chamber to intensify the spraying of water on the dishing goods arranged in a selected part of a basket within the treating chamber.

The disclosed wash zone arrangement unfortunately requires a number of additional components which makes them expensive and complicated. There is consequently a need for a flexible arrangement that provides the desired wash zone but is less complicated, and less expensive to manufacture.

SUMMARY OF THE INVENTION

The present invention, defined in the appended claims, relates to an arrangement in a dishwasher for creating a wash zone with intensified washing that to at least some extent fulfils the needs defined above. The invention furthermore relates to a dishwasher comprising said arrangement.

The arrangement according to the invention comprises:

a spray arm rotatably arranged around an axis A;

a water pump arranged to feed water to the spray arm;

a control unit arranged to control operation of the water pump; wherein at least one additional nozzle is arranged on the spray arm, said additional nozzle is arranged to be opened when the pressure in the water fed from the water pump to the spray arm exceeds a predetermined level.

The claimed arrangement fulfils the needs defined above since an intensified washing, i.e. a wash zone, could be achieved by increasing the pressure in the fed water and activate the at least one additional nozzle to spray additional water directed towards the desired are of the washing chamber. The claimed arrangement is very favourable since the wash zone is created without adding a lot of components such as further nozzles arranged remote from the spray arm and pipes for feeding the nozzles which reduces the costs for the arrangement considerably. The arrangement according to the invention is furthermore flexible since the performed washing very easy could be adapted to different needs A further advantage with the arrangement is that once the additional nozzle is opened and water prayed from the nozzle towards the dishing zone the pressure within the spray arm is reduced and the amount of water sprayed from the drive nozzles arranged on the spray arm reduced accordingly which is favourable since the water sprayed from the drive nozzles not is directed towards the dishing goods. Consequently the additional nozzle improves the performance of the arrangement since the intensity and amount of water sprayed in the wash zone is increased and the amount of water sprayed where it does not improve the dishing result is reduced. This is an important advantage especially since drive nozzles are arranged on the outer end of the spray arm to rotate the spray arm and these drive nozzles are directed such that the water is not sprayed on any dishing goods.

In one embodiment of the arrangement, the additional nozzle is arranged close to the spray arm axis A of rotation which is favourable since the area close the rotational axis A of the spray arm in conventional dishwashers have a limited or reduced spray of water.

One embodiment of the arrangement further comprising a support element arranged to rotatably support the spray arm in the washing chamber and feed water from the water pump to the spray arm, said support element further comprising an actuator member movably arranged along an axis M parallel to the axis A between a first position in which the spray arm is rotatable around the axis A and a second position in which the spray arm is prevented from rotating and an additional nozzle on the spray arm is opened, wherein the actuator member arranged to move from the first position to the second position when the pressure in the water fed from the water pump to the spray arm exceeds a predetermined level.

In one embodiment of the arrangement, the control unit is arranged to control the pressure in the water fed by the pump by increasing or reducing the speed of the pump to control the movement of the actuation member to stop and start the rotation of the spray arm.

In one embodiment of the arrangement, the actuator member comprises an elongated shaft with a first and a second end and extending along axis M, in said first end a blocking element is arranged and in the second end a nozzle closing element is arranged such that when the actuator element is in the first position the first end is free and the nozzle closing element is closing the additional nozzle, and in the second position the blocking element is arranged to block the spray arm rotation and the second end is removed from the nozzle closing position.

In one embodiment of the arrangement, the support element comprises a first element stationary arranged in the washing chamber and connected to the water pump to feed water to the spray arm.

In one embodiment of the arrangement, the elongated shaft of the actuator member is arranged to extend outside said first element and through the spray arm to the additional nozzle. This embodiment is favourable since the risk for clogging in the support element is reduced considerably since the support element could be designed with a clean interior without obstacles.

In one embodiment of the arrangement, a recess corresponding to the blocking end of the actuation member formed in the first element of the support element such that the spray arm is stopped from rotation when the actuation member is moved to the second position and the blocking member is fitted in the recess. The blocking end fitted in a recess provides a simple and reliable arrangement for maintaining the spray arm in the desired position as long as the water pressure from the water pump is kept at the high level, as well as an arrangement that is easily released once the pressure is dropped.

In one embodiment of the arrangement, a recess corresponding to the blocking end of the actuation member formed in the first element of the support element such that the spray arm is stopped from rotation when the actuation member is moved to the second position and the blocking member fitted in the recess.

In one embodiment of the arrangement, the nozzle closing element is arranged in contact with the water flow and moved by the force from the water flow from the first to the second position when the pressure in the water fed from the water pump to the spray arm exceeds the predetermined level. This embodiment adds a minimum of additional components which ensures a little risk of failure during long time as well as a cost efficient arrangement.

In one embodiment of the arrangement, the actuator member is retained in the first position by a spring. The spring ensures that the additional nozzle is closed as long as the spray arm rotates and makes it possible to achieve a precise blocking of the spray arm and opening of the additional nozzle by adjusting the spring characteristics.

In one embodiment of the arrangement, the axis A is intended to be arranged substantially vertically within the washing chamber and the actuator member retained in the first position by gravity. This arrangement is favourable since the spray arm will rotate in substantially horizontal plane resulting in a substantially uniform load distribution in the different components which facilitates the dimensioning of the components, bearings, sealing elements etc.

One embodiment of the arrangement comprises a satellite spray device (20) rotatably arranged on the spray arm. This embodiment is very favourable since the satellite spray device on the spray arm will spray water in the area of the locked spray arm which further improves the created wash zone since the amount of water sprayed within the wash zone is increased.

The invention furthermore relates to a dishwasher comprising an arrangement according to anyone of the embodiments defined above.

The different embodiment described above could of course be combined and modified in different ways without departing from the scope of the invention that will be described more in detail in the detailed description.

BRIEF DESCRIPTION OF THE DRAWINGS

Selected components of the arrangement according to the invention and a dishwasher are illustrated in the appended figures.

DETAILED DESCRIPTION

Figure 1:
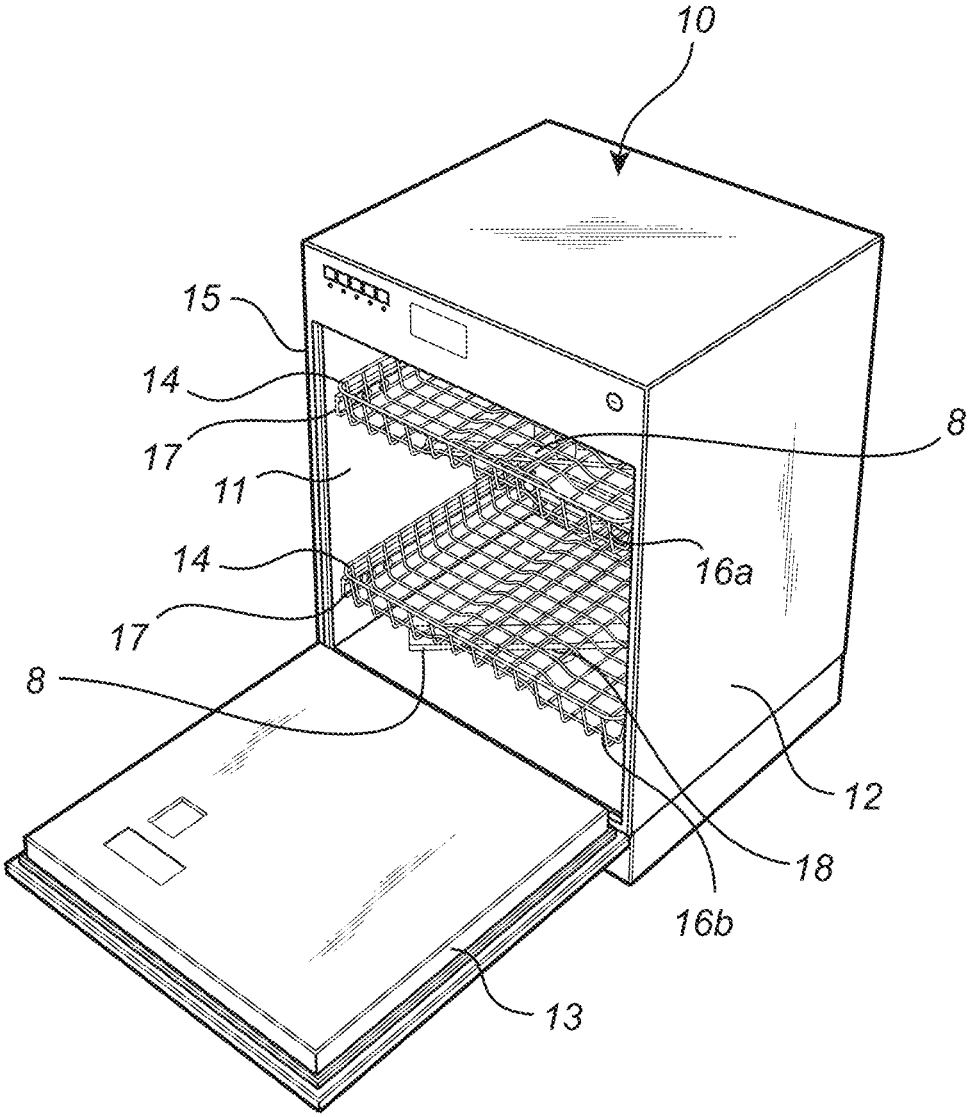
FIG. 1 discloses a schematic perspective view of a dishwasher.

In FIG. 1, a perspective schematic view of dishwasher 10 is illustrated. The dishwasher comprise a washing chamber 11 surrounded by a substantially rectangular cabinet 12. The washing chamber 11 comprises an opening 15 in the front side of the dishwasher in order to make the washing chamber 11 accessible during loading and unloading of items in and from the washing chamber. The opening 15 is closed by a door 13 in order to make it possible to access, and close, the opening 15 of the washing chamber 11. Within the washing chamber 11, an upper 16*a* and lower basket 16*b* for dirty items are arranged at different heights. The baskets are extractably arranged in the washing chamber and formed of thin elements like for example wires or rods in order to provide a basket structure that the water could flow through easily. The dishwasher 10, illustrated in FIG. 1, comprises two wire baskets 16 arranged on guide rails 17. The lower one is normally used for larger dishing goods like plates, pots etc, and the upper one for cups, glasses and smaller items. The number of baskets could however be increased further to comprise for example a third basket for small dishing goods and cutleries arranged in the top of the washing chamber.

The dishwasher operation is controlled by a control unit 25 arranged somewhere in the dishwasher 10. Most dishwashers could be operated according to different selectable programs adapted for different types of dishing goods and the control unit 25 operates the different functions and phases of the selected operation program.

Heated water, in combination with detergent, is circulated in the washing chamber by a water circulating system comprising at least a water pump 19 arranged in the lower part of the washing chamber, i.e. the sump, where water is collected and recirculated within the washing chamber 11. The water pump 19 is connected to at least one rotating spray arm 8 arranged in the washing chamber 11 to spray water in the washing chamber 11.

Figure 2:
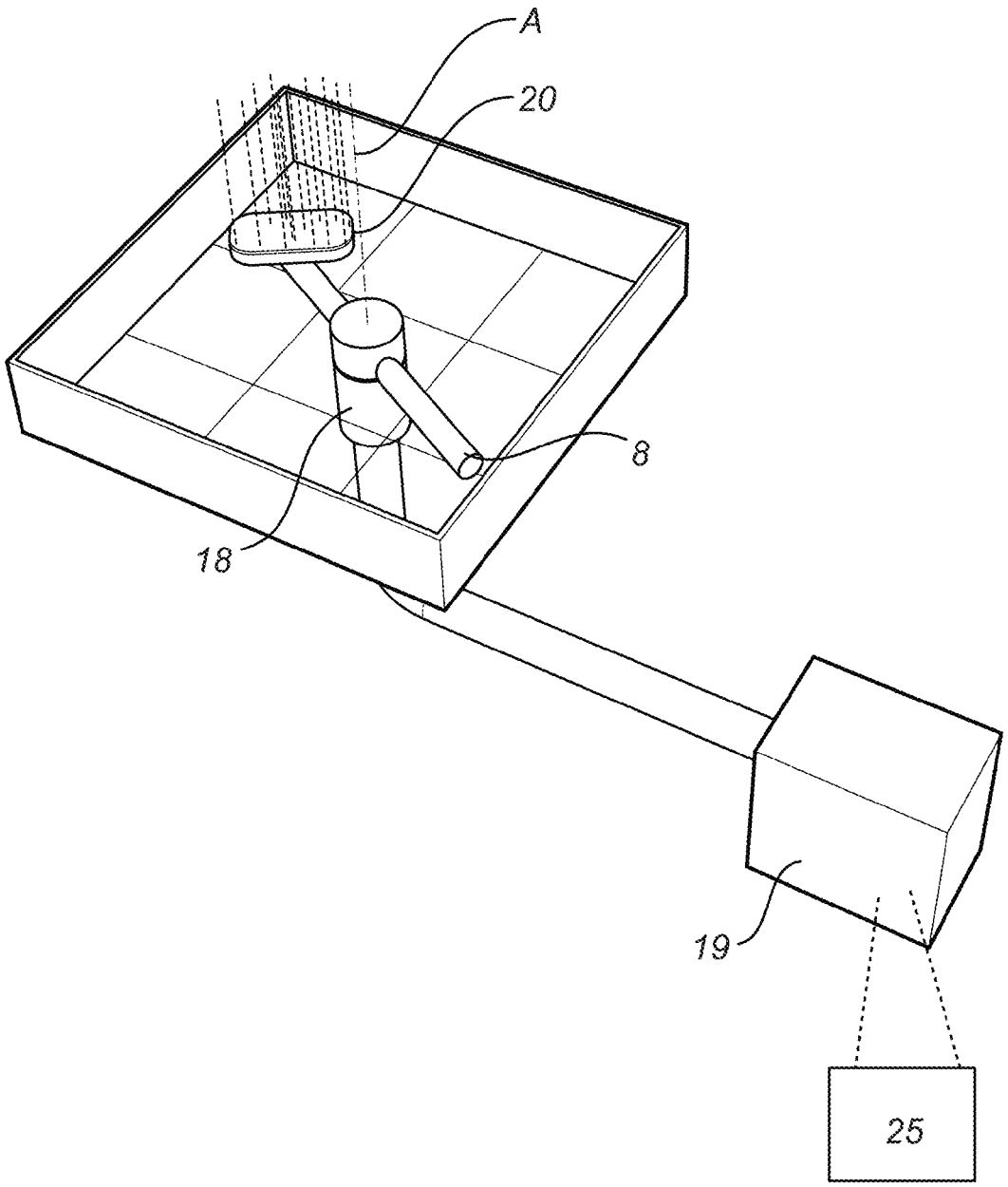
FIG. 2 discloses a spray arm schematically.

The spray arms 8, schematically illustrated in FIG. 2, are rotatably supported by a support element 18 and arranged to rotate around a substantially vertical axis A in the centre of the washing chamber 11 such that each spray arm 8 is rotating in a substantially horizontal plane within the washing chamber 11. Depending on the size and design of the dishwasher 10 the spray arm 8 is either arranged to rotate under a basket, or in an elevated position above the basket. However, dishwashers could be provided with several spray arms arranged at different heights within the washing chamber.

The spray arm 8 has an elongated shape to cover as large area as possible within the washing chamber 11 when it rotates to ensure that all dishing goods packed in the basket are washed. The spray arm 8 is rotatably supported close to the centre of the elongated spray arm by a support element 18 secured in the dishwasher to provide the required support for the spray arm 8. Water is fed from the pump 19 via the support element 18 to the spray arm 8. In one end of the spray arm 8 a satellite device 20 is rotatably secured, illustrated schematically in FIG. 2.

The satellite spray device 20 is on its upper side provided with a number of nozzles 21 to spray water on the dishing goods in a basket above the spray arm 8 when water is supplied from the pump 19. The illustrated satellite device is substantially circular but the shape could be modified in several ways such as for example as an elongated bar, illustrated in FIGS. 3*a* and 3*b*. The satellite device 20 improves the water spraying characteristics and the cleaning since more water is sprayed on the dishing goods in the area of the satellite device 20. Both the spray arm 8 and the satellite device 20 are rotated by forces generated from nozzles arranged on the spray arm and the satellite device when water is fed from the pump under pressure. Some of the nozzles on the spray arm and/or the satellite device are directed and dedicated to generate the required rotational force.

Figure 3A:
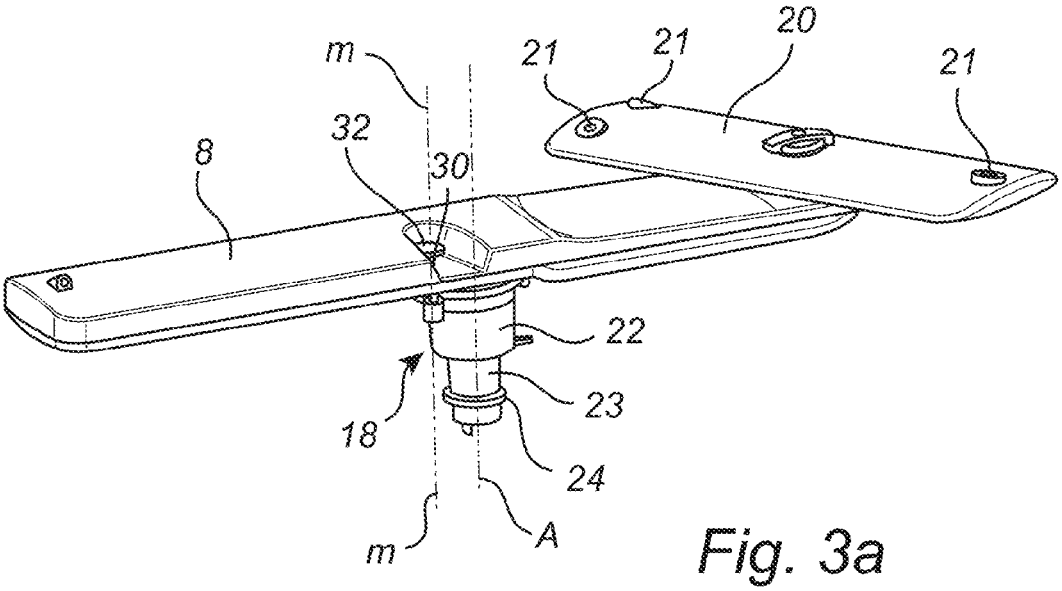
FIG. 3*a* discloses a perspective view of a spray arm provided with the additional nozzle.
Figure 3B:
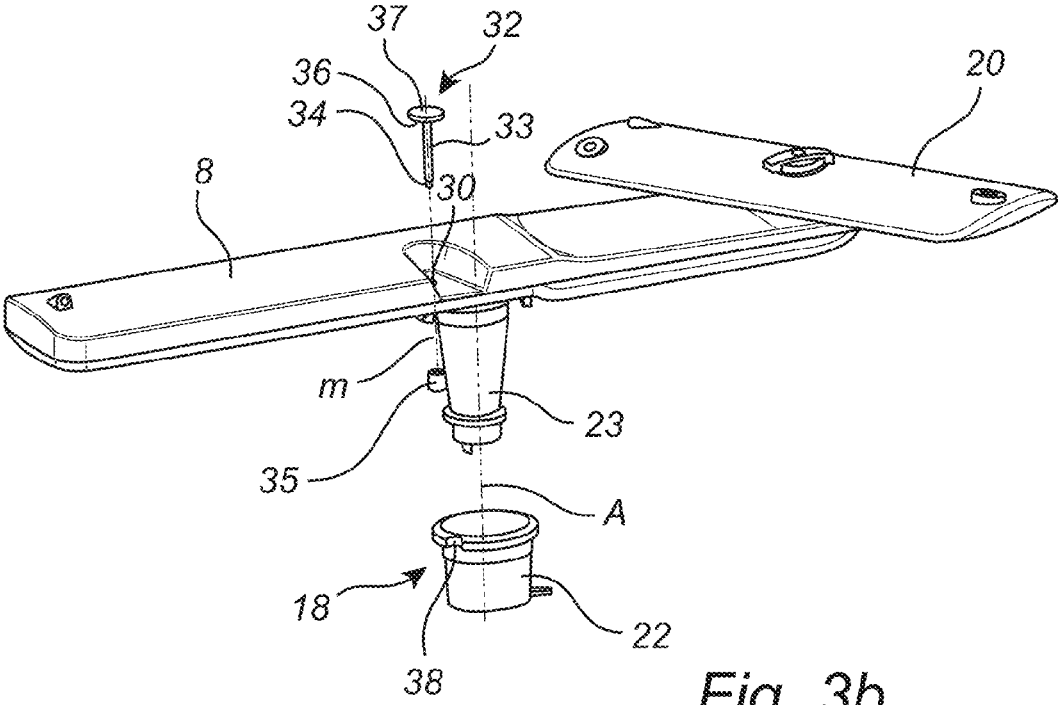
FIG. 3*b* discloses an exploded view of the spray arm in FIG. 3*a*.

The support element 18, illustrated in FIGS. 3*a* and 3*b*, comprises a first element 22 intended to be stationary arranged in the washing chamber 11 and connected to the water pump 19 to feed water to the spray arm 8, and a second element 23 attached to the spray arm 8 to rotate together with the spray arm 8.

The spray arm 8 furthermore comprises an additional nozzle 30 arranged close to axis A on the upper side of the spray arm 8. The additional nozzle 30 could be opened to spray extra water by increasing the pressure in the water fed from the water pump 19 to the spray arm 8 to exceed a predetermined level. This is very favourable since a more intense washing could be activated by the control unit 25 during a selected phase of the dishwasher program thereby improving the cleaning.

In one preferred embodiment of the arrangement the additional nozzle 30 is arranged to spray water in the centre of the washing chamber 11 above the additional nozzle 30 where a satisfying result not always is achieved since the area in the centre of the washing chamber not is covered by the satellite device 20. The additional nozzle could also be directed towards the satellite device 20 to further improve the washing in that area. Further nozzles of the same type could be arranged along the spray arm even though this embodiment not is illustrated in the figures.

In one preferred embodiment the first element 22 is shaped like pipe arranged with the longitudinal axis of the pipe coaxial to the axis A. The second element 23 is shaped like an elongated cone coaxial to the axis A with the narrow end arranged downwards and the upper end secured in the spray arm 8. The diameter of the upper end of the cone-shaped second element 23 is smaller than the inner diameter of the first element 22 such that the second element 23 could be fitted in the first element 22. Close to the lower end of the cone-shaped second element 23 an annular flange 24 is extending around the second element 23. The annular flange 23 is intended to provide a sealing between the first 22 and second 23 element to prevent leakage as well as additional support for the second element 23 in the first element 22. The support element 18 furthermore comprises an actuator member 32 movably arranged along an axis M substantially parallel to the axis A. The actuator member 32 is movable between a first position in which the spray arm 8 is free to rotate around the axis A and the additional nozzle 30 closed, and a elevated second position in which the spray arm 8 is locked and prevented from rotating around axis A and the additional nozzle 30 on the spray arm 8 opened to spray further water.

During the period the spray arm 8 is locked the satellite device 20 will continue to rotate and spray water within the area covered by the satellite. The locking of the spray arm creates a wash zone where intense washing is provided which in combination with the opened additional nozzle 30 provide excellent washing characteristics.

The actuator member 32 is during the moved from the first to the second position at the same time locking the spray arm 8 and opening the additional nozzle 30, i.e. by increasing the pressure in the water fed from the water pump 19 to the spray arm 8 above the predetermined level.

The actuator member 32 comprises an elongated shaft 33 extending along the axis M substantially parallel to the axis A outside the periphery of the first element 22 of the support element 18. The elongated shaft 33 comprises a first end 34 provided with a blocking element 35, and a second end 36 in which a nozzle closing element 37 is arranged such that when the actuator element 32 is in the first position the first end 34 is free and the second end 36 is closing the additional nozzle 30 arranged on a the spray arm 8. In the exploded view in FIG. 3*b* the blocking element is illustrated separately from the shaft 33 which is necessary to make it possible to assemble the different components. Once the shaft 33 of the actuator member 32 is fitted through the spray arm from above the blocking element 35 is secured to the shaft 33 to constitute a part of the actuator member 32.

In the illustrated embodiment, the nozzle closing element is shaped like a circular plate arranged substantially transverse to the axis M. The lower side of the nozzle closing element 37 is intended to be in contact with a corresponding surface on the outside surface of the additional nozzle 30 to close the nozzle 30.

In the second position the blocking element 35 in the first end 34 of the actuator member is blocking the spray arm rotation and the second end 36 removed from the nozzle closing position to open the additional nozzle 30 and increase the spray of water on the area surrounding the additional nozzle.

On the outside surface of the first element 22 of the support element 18 a recess 38 with a shape and size corresponding to the blocking element 35 of the actuation member 32 is formed such that the spray arm 8 is stopped from rotation when the actuation member 32 is moved to the second position and the blocking member 35 fitted in the recess 38. The recess 38 is formed in a radially extending flange 39 arranged around the upper edge of the first element 22. The recess 38 in the first element 22 is positioned such that the spray arm 8 and satellite spray device 20 are positioned in the intended position for the wash zone when the blocking element 35 is fitted in the recess 38. When the actuator member 32 is in the first position the blocking element 35 is rotating freely below the recess 38

The elongated shaft 33 of the actuator member is in the illustrated embodiment extending through the spray arm 8 and outside the first element 22 of the support element 18 below the spray arm 8. The fact that the elongated shaft 33 is arranged outside the support element 18 is favourable to since the influences on the water flow within the support element and the spray arm from the actuator member 32 are limited. The only part of the actuator member 32 interfering with the water flow is the elongated shaft 33 extending through the spray arm 8. Furthermore the risk for clogging in the support element 18 is reduced when the major part of the actuator member 32 is arranged outside the support element 18 separately from the flow of water. The nozzle closing element 37 must however be in contact with the water flow in the spray arm 8 to be moved by the force from the pressurized water from the first to the second position when the pressure is increased.

The actuator member 32 is retained in the first position either by a spring that is applying a force on the actuator member in the direction towards the first position and/or by gravity and the rotation of the spray arm 8 stopped when force from the pressurized water exceeds the spring force alternatively the gravity of the actuator member 32 and the actuator member 32 moved vertically from the first to the second position.

The dishwasher operation is controlled by a control unit 25 arranged in the dishwasher 10. The control unit 25 operates the different functions and phases of the selected operation program of the dishwasher 10. The control unit 25 furthermore controls the operation of the water pump 29 and increases/reduces the speed of the water pump to activate/deactivate the wash zone and open/close the additional nozzle 30.

The embodiments described above could be combined and modified in different ways without departing from the scope of the invention that is defined by the appended claims.

The invention claimed is:

1. An arrangement in a dishwasher for creating a wash zone with intensified washing in a washing chamber, said arrangement comprising:

a spray arm rotatably arranged around an axis (A), the spray arm comprising at least one nozzle and at least one additional nozzle;

a water pump arranged to feed water to the spray arm;

a control unit arranged to control operation of the water pump; and an actuator member movably arranged between a first position in which the spray arm is rotatable around the axis (A) and a second position in which the spray arm is prevented from rotating and the at least one additional nozzle on the spray arm is opened, wherein the actuator member is arranged to move from the first position to the second position when the pressure in the water fed from the water pump to the spray arm exceeds a predetermined level, and wherein the at least one additional nozzle is arranged to be opened when pressure in the water fed from the water pump to the spray arm exceeds the predetermined level, such that when the pressure is below the predetermined level, the spray arm is configured to emit the water from the at least one nozzle and not the at least one additional nozzle, and when the pressure exceeds the predetermined level, the spray arm is configured to emit the water from both the at least one nozzle and the at least one additional nozzle.

2. The arrangement according to claim 1, wherein the at least one additional nozzle is arranged close to the spray arm axis (A) of rotation.

3. The arrangement according to claim 1, wherein the at least one additional nozzle is arranged to spray water in a center of the washing chamber.

4. The arrangement according to claim 1, further comprising a support element arranged to rotatably support the spray arm in the washing chamber and feed water from the water pump to the spray arm, said support element further comprising the actuator member movably arranged along an axis (M) parallel to the axis (A).

5. The arrangement according to claim 4, wherein the actuator member comprises an elongated shaft with a first and a second end and extending along axis (M), in said first end a blocking element is arranged and in the second end a nozzle closing element is arranged such that when the actuator element is in the first position the first end is free and the nozzle closing element is closing the at least one additional nozzle in a nozzle closing position, and in the second position the blocking element is arranged to block the spray arm rotation and the second end is removed from the nozzle closing position.

6. The arrangement according to claim 5, wherein the support element comprises a first element stationary arranged in the washing chamber and connected to the water pump to feed water to the spray arm.

7. The arrangement according to claim 6, wherein the said elongated shaft of the actuator member is arranged to extend outside said first element and through the spray arm to the at least one additional nozzle.

8. The arrangement according to claim 7, wherein a recess corresponding to the blocking element at the first end of the actuator member is formed in the first element of the support element such that the spray arm is stopped from rotation when the actuator member is moved to the second position and the blocking element is fitted in the recess.

9. The arrangement according to claim 8, wherein the recess is positioned such that the spray arm is positioned in an intended position for the wash zone when the actuator member is moved to the second position and the blocking element is fitted in the recess.

10. The arrangement according to claim 5, wherein the nozzle closing element is arranged in contact with the water flow and arranged to be moved by the force from the water flow from the first to the second position when the pressure in the water fed from the water pump to the spray arm exceeds the predetermined level.

11. The arrangement according to claim 4, further comprising a spring arranged to retain the actuator member in the first position.

12. The arrangement according to claim 4, wherein the actuator member retained in the first position by gravity.

13. The arrangement according to claim 1, wherein the control unit is arranged to control the pressure in the water fed by the pump by increasing or reducing the speed of the pump.

14. The arrangement according to claim 1, wherein the at least one additional nozzle is directed to spray water towards a wash zone.

15. The arrangement according to claim 1 comprising a satellite spray device rotatably arranged on the spray arm.

16. A dishwasher comprising an arrangement for creating a wash zone with intensified washing in a washing chamber, said arrangement comprising:

a spray arm rotatably arranged around an axis (A), the spray arm comprising at least one nozzle and at least one additional nozzle;

a water pump arranged to feed water to the spray arm;

a control unit arranged to control operation of the water pump; and an actuator member movably arranged between a first position in which the spray arm is rotatable around the axis (A) and a second position in which the spray arm is prevented from rotating and the at least one additional nozzle on the spray arm is opened, wherein the actuator member is arranged to move from the first position to the second position when the pressure in the water fed from the water pump to the spray arm exceeds a predetermined level, and wherein the at least one additional nozzle is arranged to be opened when pressure in the water fed from the water pump to the spray arm exceeds the predetermined level, such that when the pressure is below the predetermined level, the spray arm is configured to emit the water from the at least one nozzle and not the at least one additional nozzle, and when the pressure exceeds the predetermined level, the spray arm is configured to emit the water from both the at least one nozzle and the at least one additional nozzle.

17. An arrangement in a dishwasher for creating a wash zone with intensified washing in a washing chamber, said arrangement comprising:

a spray arm rotatably arranged around an axis (A), wherein at least one nozzle is arranged on the spray arm;

a water pump arranged to feed water to the spray arm;

a control unit arranged to control operation of the water pump; and an actuator member comprising a nozzle closing element and a blocking element, wherein the actuator member defines a first position and a second position, wherein the actuator member is configured to move from the first position to the second position when pressure in the water fed from the water pump to the spray arm exceeds a predetermined level, and wherein in the first position of the actuator member, the nozzle closing element is configured to close the at least one nozzle and the spray arm is configured to rotate about the axis (A); and wherein in the second position of the actuator member, the nozzle closing element is configured to open the at least one nozzle and the blocking element is configured to engage a stationary recess to rotationally lock the spray arm.

18. The arrangement according to claim 17, wherein the actuator member comprises an elongated shaft having the blocking element disposed at a first end and the nozzle closing element disposed at a second end.

19. The arrangement according to claim 18, wherein the nozzle closing element comprises a circular plate.

* * * * *